US010030643B2

(12) United States Patent
Beenker et al.

(10) Patent No.: US 10,030,643 B2
(45) Date of Patent: Jul. 24, 2018

(54) PUMP DEVICE HAVING A ROLLER BEARING-LIKE STRUCTURE

(71) Applicant: Qonqave GmbH, Wernau (DE)

(72) Inventors: Jan W. Beenker, Stuttgart (DE); Raymond Ritschka, Weissach (DE); Lars Redschlag, Stuttgart (DE)

(73) Assignee: Qonqave GmbH, Wernau (DE)

( * ) Notice: Subject to any disclaimer, the term of this patent is extended or adjusted under 35 U.S.C. 154(b) by 0 days.

(21) Appl. No.: 15/537,151

(22) PCT Filed: Dec. 17, 2015

(86) PCT No.: PCT/EP2015/080292
§ 371 (c)(1),
(2) Date: Jun. 16, 2017

(87) PCT Pub. No.: WO2016/097184
PCT Pub. Date: Jun. 23, 2016

(65) Prior Publication Data

US 2017/0350384 A1 Dec. 7, 2017

(30) Foreign Application Priority Data

Dec. 17, 2014 (DE) ..... 10 2014 118 924
Dec. 17, 2014 (DE) ..... 10 2014 118 925
Dec. 17, 2014 (DE) ..... 10 2014 118 926

(51) Int. Cl.
*F04B 43/08* (2006.01)
*F04B 43/12* (2006.01)

(52) U.S. Cl.
CPC ..... *F04B 43/1261* (2013.01)

(58) Field of Classification Search
CPC ... F04B 43/1261; F16C 2360/42; F16C 4/005
(Continued)

(56) References Cited

U.S. PATENT DOCUMENTS 2,755,893 A 7/1956 Male
3,229,643 A 1/1966 Roudaut
(Continued)

FOREIGN PATENT DOCUMENTS

CA 2 422 579 C 3/2003
CH 639 462 A5 * 11/1983
(Continued)

OTHER PUBLICATIONS

Search Report dated Oct. 15, 2015 issued in corresponding DE patent application No. 10 2014 118 925.6 (and partial English translation).
(Continued)

*Primary Examiner* — Charles Freay
(74) *Attorney, Agent, or Firm* — Posz Law Group, PLC

(57) ABSTRACT

A pump device with at least one conveying device at least for a conveyance of a fluid, includes at least one drive unit for acting onto the conveying device. The conveying device includes at least one conveying space element, which at least partly delimits the conveying space and is embodied in a rigid fashion, and at least one elastically deformable conveying element, which forms the conveying space together with the conveying space element. The conveying element is embodied in a spring-elastic fashion, wherein the conveying element, following a deformation, automatically seeks to re-assume a basic shape, in particular a convexly curved basic shape of the conveying element, wherein, for a conveyance of a fluid, the conveying element is movable, starting from a convex curvature, which is oriented in a direction facing away from the conveying space element, towards the conveying space element, wherein at least the conveying space element and the conveying element together form an exchangeable unit.

12 Claims, 4 Drawing Sheets

Figure 1:
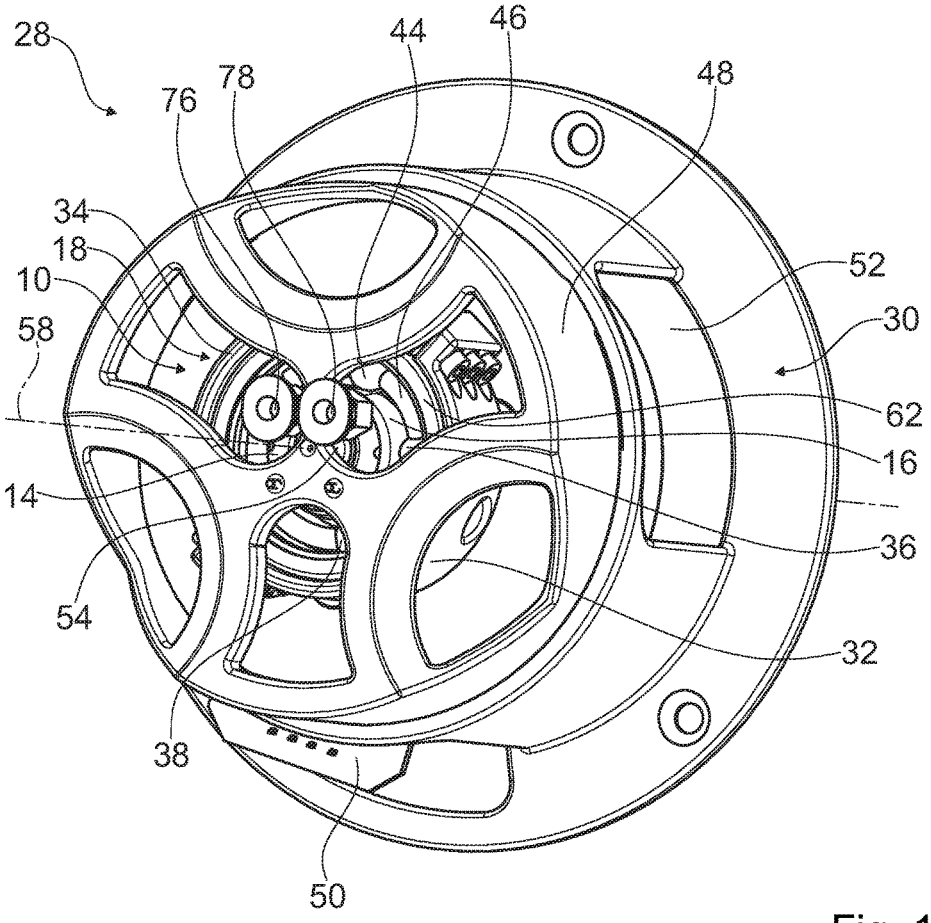

(58) Field of Classification Search
USPC ..... 417/477.1
See application file for complete search history.

(56) References Cited

U.S. PATENT DOCUMENTS

| | | | | |
|---|---|---|---|---|
| 4,236,880 | A | 12/1980 | Archibald | |
| 5,563,347 | A | 10/1996 | Martin et al. | |
| 2007/0071382 | A1 * | 3/2007 | Suzuki | F16C 33/6674 384/462 |
| 2012/0177506 | A1 | 7/2012 | Örter | |

FOREIGN PATENT DOCUMENTS

| | | | | |
|---|---|---|---|---|
| DE | 35 42 454 | A1 | | 6/1987 |
| DE | 10 2007 034 125 | A1 | | 1/2009 |
| DE | 10 2009 037 845 | A1 | | 4/2011 |
| DE | 10 2012 206 425 | | * | 10/2013 |
| EP | 0 026 704 | | * | 9/1980 |
| EP | 1 317 626 | B1 | | 8/2006 |
| FR | 2 523 656 | A1 | | 9/1983 |
| WO | 2007/051454 | A2 | | 5/2007 |

OTHER PUBLICATIONS

Search Report dated Oct. 15, 2015 issued in corresponding DE patent application No. 10 2014 118 924.8 (and partial English translation).

Search Report dated Oct. 15, 2015 issued in corresponding DE patent application No. 10 2014 118 926.4 (and partial English translation).

International Search Report of the International Searching Authority dated Mar. 29, 2016 issued in corresponding International Patent Application No. PCT/EP2015/080292.

International Preliminary Report on Patentability dated Jun. 22, 2017 issued in corresponding International Patent Application No. PCT/EP2015/080292 (and German version of Nov. 22, 2016 with Article 34 amendments).

* cited by examiner

PUMP DEVICE HAVING A ROLLER BEARING-LIKE STRUCTURE

CROSS REFERENCE TO RELATED APPLICATIONS

This application is a U.S. national stage application of PCT/EP2015/080292 filed on Dec. 17, 2015, which claims priority to German Patent Application No. DE 10 2014 118 924.8 filed on Dec. 17, 2014, German Patent Application No. DE 10 2014 118 925.6 filed on Dec. 17, 2014, and German Patent Application No. DE 10 2014 118 926.4 filed on Dec. 17, 2014, the contents of which are incorporated herein by reference.

PRIOR ART

The invention relates to a pump device as per the preamble of claim 1.

EP 1 317 626 B1, U.S. Pat. No. 4,236,880 A and U.S. Pat. No. 5,563,347 A have already disclosed pump devices with a conveying device for conveying a fluid, wherein the conveying device comprises a conveying space, a conveying space element which at least partly delimits the conveying space and is embodied in rigid fashion, and an elastically deformable conveying element, which forms the conveying space together with the conveying space element.

Furthermore from DE 10 2009 037 845 A1 a pump device is known, with at least one conveying device for a conveyance of a fluid, and with a drive unit for acting onto the conveying device, wherein the conveying device comprises a conveying space, a conveying space element, which delimits the conveying space and is embodied in a rigid fashion, and an elastically deformable conveying element, which forms the conveying space together with the conveying space element. The conveying element is embodied in a spring-elastic fashion and, following a deformation, automatically seeks to re-assume a basic shape, in particular a convexly curved basic shape of the conveying element, wherein, for conveying a fluid, the conveying element is movable, starting from a convex curvature that is oriented in a direction facing away from the conveying space element, towards the conveying space element. The conveying space element and the conveying element together form an exchangeable unit.

It is the object of the invention in particular to provide a generic device with improved characteristics with regard to compact implementation and to conveying performance as well as to a convenient exchangeability of individual components and/or units with at least substantially loss-free conveying performance, in particular in and/or through a conveying space, in order, in particular, to permit a demand for at least substantially sterile use or in order to permit fast replacement of defective components and/or units. The object is achieved according to the invention by means of the features of patent claim 1, whereas advantageous embodiments and refinements of the invention emerge from the subclaims.

Advantages of the Invention

The invention is based on a pump device with at least one conveying device at least for a conveyance of a fluid, and with at least one drive unit for acting onto the conveying device, wherein the conveying device comprises at least one conveying space, at least one conveying space element, which at least partly delimits the conveying space and is embodied in a rigid fashion, and at least one elastically deformable conveying element, which forms the conveying space together with the conveying space element, wherein the conveying element is embodied in a spring-elastic fashion, wherein the conveying element, following a deformation, automatically seeks to re-assume a basic shape, in particular a convexly curved basic shape, of the conveying element, wherein, for a conveyance of a fluid, the conveying element is movable, starting from a convex curvature, which is oriented in a direction facing away from the conveying space element, towards the conveying space element, wherein at least the conveying space element and the conveying element together form an exchangeable unit.

It is proposed that the drive unit comprises at least one movably supported drive element. which encloses the conveying space, in particular the conveying device, at least to a large extent, wherein the drive unit comprises at least one force action element, which is configured to at least partly circulate around the conveying space, wherein the conveying space is implemented in an annulus-shaped fashion, wherein the conveying space extends, viewed in a plane, about a center point which is arranged on an axis of rotation of the drive element, wherein the conveying space element comprises at least one concave recess for at least partly forming the conveying space. The expression "spring-elastic" is to be understood in particular to mean a characteristic of an element, in particular of the conveying element, which characteristic is provided in particular for generating an opposing force which is dependent on a change in a shape of the element and which is preferably proportional to the change and which counteracts the change. The conveying element is preferably repeatedly deformable without the conveying element thereby being mechanically damaged or destroyed. In particular, the conveying element automatically seeks to re-assume a basic shape after a deformation, in particular a convexly curved basic shape of the conveying element. The spring-elastic form of the conveying element can preferably be at least partly influenced and/or realized by means of the convex arrangement on the conveying space element. The conveying element is preferably arranged on the conveying space element such that a conveying medium is conveyed in and/or through the conveying space as a result of an inward bulging of the conveying element. After an elimination of an action of a drive force on the conveying element for a conveyance of a conveying medium, the conveying element, preferably at least substantially automatically, seeks to re-assume the convexly curved arrangement on the conveying space element, in particular owing to the spring-elastic form. The conveying element is preferably produced from a spring steel or from a fiber composite material. It is however also conceivable for the conveying element to be produced from some other material which appears expedient to a person skilled in the art and which permits a spring-elastic form of the conveying element. The conveying element preferably utilizes a "bulging effect" for a conveyance of a conveying medium in and/or through the conveying space. The conveying element can preferably be at least temporarily inwardly bulged for a conveyance of a conveying medium, wherein at least one bulge is displaceable, in particular displaceable in rolling fashion, along a longitudinal axis of the conveying element for the purposes of conveying a conveying medium. The conveying element is preferably of dimensionally stable form. Here, "dimensionally stable" is to be understood to mean that the conveying element is formed so as to be resilient in terms of shape with respect to pressure, heat or the like.

Here, an "exchangeable unit" is to be understood in particular to mean a unit which is removable as a whole, in particular without being destroyed or without disassembly of individual parts, from an element or from a further unit, such as for example from a housing unit or the like, in particular after a release of at least one fastening element which is provided for fastening and/or aligning the unit on the element or on the further unit. In particular, the exchangeable unit is at least substantially free from function, and/or non-functional, when in a removed state, in particular in a state removed from the housing unit.

The conveying device is preferably provided for being arranged on the pump device. The expression "provided" is to be understood in particular to mean specially designed and/or specially equipped. The statement that an element and/or a unit are/is provided for a particular function is to be understood in particular to mean that the element and/or the unit perform(s) and/or carry/carries out said particular function in at least one usage and/or operating state. The exchangeable unit is preferably removable as a whole from the element or from the further unit without being disassembled into individual parts. It is thus preferably the case that at least the conveying space element and the conveying element are jointly removable from the element or from the further unit, in particular from a housing unit of the pump device which comprises the conveying device. It is preferable if the exchangeable unit is, after being removed from the element or from the further unit, exchangeable for a replacement or substitute unit which, with regard to at least one function of the replacement or substitute unit, at least substantially corresponds to at least one function of the exchangeable unit. The exchangeable unit is preferably designed such that, in the event of an exchange of the exchangeable unit, a loss of fluid and/or an escape of fluid from the conveying device and/or from the pump device are/is at least substantially preventable. The exchangeable unit preferably has at least one valve which is provided so as to at least substantially prevent a loss of fluid and/or an escape of fluid from the conveying device and/or from the pump device in the event of a removal of the exchangeable unit. The exchangeable unit is preferably formed as a disposable article unit. It is however also conceivable for the exchangeable unit to be in the form of an interchangeable unit, a wearing part unit, a substitute unit or the like. The conveying device is preferably provided for use in the medical sector. It is however also conceivable for the conveying device to be provided for use in other sectors in which easy exchangeability at least of the conveying space element and of the conveying element, which at least together form the exchangeable unit, is expedient or necessary, for example in a foodstuffs sector, in a chemistry sector, in a pharmaceutical sector, in particular for batch-compliant use, in a vivarium sector (aquarium etc.), in a household appliance sector, in a dental hygiene sector, in an automotive sector, in particular for a supply of at least one additive or the like.

Here, the expression "embodied in a rigid fashion" is intended in particular to define an embodiment of an element in which the element is of at least substantially stiff, immovable and/or inelastic form. The conveying space element is thus preferably provided so as to remain at least substantially, in particular entirely, unchanged in terms of shape for a conveyance of a fluid. The conveying space element preferably has at least one concave recess for at least partly delimiting and/or for at least partly forming the conveying space. Thus, an inner surface, which delimits the recess, of the conveying space element preferably forms a wall of the conveying space. The conveying element is preferably provided so as to be deformed, in particular elastically deformed, for a conveyance of a fluid. The conveying element is preferably provided so as to permit a conveyance of a fluid out of and/or through the conveying space as a result of a deformation of the conveying element. The conveying element is preferably deformable such that, for a conveyance of a fluid, the conveying element is movable in the direction of the recess and is in particular movable at least partly into said recess. It is thus advantageously possible to realize dynamic conveyance of a fluid or conveyance of a fluid with displacement action. For conveyance of a fluid with displacement action, the conveying element can preferably be caused, as a result of a deformation, to at least partly bear directly, in particular in form-fitting fashion, against the inner surface of the conveying space element. The conveying element is preferably in the form of a diaphragm pump element, in particular a flexurally rigid and/or spring-elastic diaphragm pump element. The conveying element is preferably formed so as to differ from a peristaltic pump element, in particular an expansion-flexible hose of a peristaltic pump device.

The conveying element can advantageously be arranged at least partly in convexly curved fashion on the conveying space element. The conveying element is preferably, in a state of non-conveyance, arranged at least partly in convexly curved fashion on the conveying space element. For a conveyance of a fluid, the conveying element is preferably movable, in particular elastically deformable, in the direction of the conveying space element proceeding from a convex curvature oriented in a direction pointing away from the conveying space element, and is in particular movable at least partly into the concave recess of the conveying space element. For a conveyance of a fluid, the conveying element can preferably be changed at least partly from a convex curvature into a concave curvature. The conveying element can preferably be caused to bear at least partly against the inner surface, which delimits the concave recess of the conveying space element and which is oriented in particular in the direction of the conveying element, of the conveying space element, in particular owing to a drive force acting on the conveying element. It is very particularly preferably possible for at least one conveying surface of the conveying element to be caused to bear entirely against the inner surface of the conveying space element, which inner surface delimits the concave recess of the conveying space element, as a result of an elastic deformation, in particular a repeatable spring-elastic deformation, of the conveying element, in particular owing to a drive force acting on the conveying element.

The conveying element is advantageously connected at least substantially non-detachably to the conveying space element. Here, the expression "at least substantially non-detachably" is to be understood in particular to mean a connection of at least two elements which are separable from one another only with the aid of separating tools, such as for example a saw, in particular a mechanical saw etc., and/or chemical separating agents, such as for example solvents etc. The conveying element may be connected along an entire circumference, in particular as viewed in at least one plane, in at least substantially non-detachable fashion to the conveying space element, or the conveying element may be connected by means of at least one single side in at least substantially non-detachable fashion to the conveying space element, for example by means of a film hinge or the like. The conveying element and the conveying space element are preferably formed in one piece, for example by means of an injection molding process or the like, in particular with an at least substantially non-detachable connection of the conveying element and of the conveying space element by means of a film hinge or the like. The conveying element and the conveying space element are preferably formed from an identical material, for example plastic. It is however also conceivable for the conveying element and the conveying space element to be formed from different materials and to be connected to one another in at least substantially non-detachable fashion.

The conveying element is preferably provided for sealing off at least one edge region, which delimits the conveying space, of the conveying space element, in particular in at least a state in which the conveying element is arranged on the conveying space element. The conveying element can preferably be arranged on the conveying space element such that the at least one edge region, which delimits the conveying space, of the conveying space element can be sealed off. Sealing-off of the at least one edge region, which delimits the conveying space, of the conveying space element may be realized directly by means of the conveying element. It is however alternatively or additionally also conceivable for a seal element of the conveying device to be provided which can be arranged between the conveying element and the conveying space element, in particular on the at least one edge region, which delimits the conveying space, of the conveying space element. The seal element of the conveying device may be formed as a rubber seal, as a sealing cord, as a sealing lip, as a flexible seal compound, as a fiber seal, as a paper seal or the like.

Here, the expression "conveying space" defines in particular a space which is delimited at least by the conveying element and by the conveying space element and which extends between the conveying element and the conveying space element at least from an inlet of the space, through which a fluid for conveying can be introduced into the space, to at least one outlet of the space, through which a conveying medium for conveying can be discharged from the space. It is preferable for the conveying space to extend between the conveying element and the conveying space element at least from a conveying space inlet of the conveying space to a conveying space outlet of the conveying space.

It is conceivable for the conveying device to comprise at least one conveying medium store unit for storing a conveying medium, in particular a fluid, wherein the conveying medium store unit forms the exchangeable unit together with the conveying space element and the conveying element. It is however also conceivable for the conveying medium store unit to be formed separately from the exchangeable unit, in particular in an alternative embodiment of the conveying device and/or of the pump device. Here, a "conveying medium store unit" is to be understood in particular to mean a unit which has at least one storage space in which a conveying medium, in particular a fluid, can be stored. It is preferable for a volume of the storage space of the conveying medium store unit to be larger than the conveying space, which is formed at least by the conveying element and the conveying space element. The conveying medium store unit is preferably formed in the manner of a tank. Here, the conveying medium store unit may be in the form of a carpule, an ampule, a cartridge or the like. The conveying medium store unit is preferably arranged adjacent to the conveying space inlet of the conveying space which is formed at least by the conveying element and by the conveying space element. The conveying medium store unit is preferably connected in terms of flow to the conveying space which is formed at least by the conveying element and by the conveying space element. It is preferable for an outlet of the conveying medium store unit to be connected, in particular connected in fluid-tight fashion, by means of at least one duct of the conveying device to the conveying space inlet of the conveying space which is formed at least by the conveying element and by the conveying space element. A fluid stored in the storage space of the conveying medium store unit can thus advantageously be conveyed out of the storage space by means of an interaction of the conveying element and conveying space element.

The conveying medium store unit is preferably connected at least substantially non-detachably to the conveying space element. The conveying medium store unit is preferably connected at least substantially non-detachably to the conveying space element at least by an operator and/or user of the conveying device. A connection between the conveying medium store unit and the conveying space element is preferably sealed. It is thus advantageously possible for unauthorized separation of the conveying medium store unit and conveying space element to be identified. It is advantageously possible for inadmissible re-use to be advantageously prevented, and for compliance with single use to be advantageously ensured. By means of the embodiment according to the invention, it is advantageously possible to achieve easy exchangeability of the conveying medium store unit together with the conveying space element and in particular together with the conveying element.

By means of the embodiment of the conveying device according to the invention, it is advantageously possible to permit convenient exchangeability of individual components and/or units in order, in particular, to permit a demand for at least substantially sterile use or in order to permit fast replacement of defective components and/or units. Furthermore, by means of the embodiment according to the invention, it is advantageously possible to realize a conveying device which has a small number of components and which can be of advantageously compact design. It is advantageously possible to realize a conveying device which permits an exchange at least of the conveying element and of the conveying space element in a manner similar to an ink or printer cartridge.

It is furthermore proposed that the spring-elastic conveying element comprises at least one conveying surface which, viewed in a cross-section of the conveying element, has a maximum transverse extent which is at least substantially equivalent to a maximum transverse extent of a wall of the conveying space element, which wall at least partly delimits the conveying space. In an alternative embodiment, it is possible, in order to achieve the above-stated object, for the conveying device to be formed independently from the exchangeable unit. In the alternative embodiment, in particular in the embodiment formed independently from the exchangeable unit, the conveying device preferably comprises at least one conveying space, at least one conveying space element, which at least partly delimits the conveying space and is embodied in a rigid fashion, and at least one elastically deformable conveying element, which forms the conveying space together with the conveying space element, wherein the spring-elastic conveying element comprises at least one conveying surface which, viewed in a cross-section of the conveying element, has a maximum transverse extent which is at least substantially equivalent to a maximum transverse extent of a rigid wall of the conveying space element, which wall at least partly delimits at least the conveying space. The expression "at least substantially" is to be understood, in particular at least in conjunction with extents and/or dimensioning, to mean that a deviation deviates from a predefined value by in particular less than 25%, preferably less than 10%, particularly preferably less than 5% of the predefined value, and very particularly preferably corresponds entirely to the value. It is particularly preferable if the conveying element comprises at least one conveying surface which, viewed in a cross-section of the conveying element, has a maximum transverse extent which is equivalent to, in particular entirely equivalent to or congruent with, a maximum transverse extent of a rigid wall of the conveying space element, which wall at least partly delimits at least the conveying space. The conveying element preferably has, in an unloaded state of the conveying element, a conveying surface which, viewed in a cross-section of the conveying element, has a maximum transverse extent which is equivalent to a maximum transverse extent of a rigid wall of the conveying space element, which wall at least partly delimits at least the conveying space. It may also conceivably be provided that, in an unloaded state of the conveying element, the maximum transverse extent of the conveying surface of the conveying element is equivalent to the maximum transverse extent of the rigid wall of the conveying space element, which wall at least partly delimits at least the conveying space. Here, a "conveying surface" is to be understood in particular to mean a surface of the conveying element which can be utilized in targeted fashion for a conveyance of a fluid in the conveying space and/or through the conveying space and/or which comes into direct contact with a fluid for conveying, in particular during a conveyance of a fluid. It is preferable for the maximum transverse extent of the conveying surface to run at least substantially transversely, in particular at least substantially perpendicularly, to a conveying direction in the conveying space. The conveying direction in the conveying space preferably runs from the conveying space inlet to the conveying space outlet. Here, the expression "at least substantially transversely" is to be understood in particular to mean an orientation of a direction and/or of an axis relative to a reference direction and/or a reference axis, wherein the orientation of the direction and/or of the axis is at least different from an at least substantially parallel orientation with respect to the reference direction and/or with respect to the reference axis and is in particular skewed or perpendicular with respect to the reference direction and/or with respect to the reference axis. Here, the expression "at least substantially perpendicular" is intended in particular to define an orientation of a direction relative to a reference direction, wherein the direction and the reference direction, viewed in particular in one plane, enclose an angle of 90° and the angle has a maximum deviation of in particular less than 8°, advantageously less than 5° and particularly advantageously less than 2°. By means of the embodiment according to the invention, it is advantageously possible to permit reduced loading of the conveying element as a result of a deformation. Furthermore, it is advantageously possible to achieve a high level of variability with regard to an activation of the conveying device.

It is furthermore proposed that at least one two-dimensional geometry of an entire conveying contour of a rigid wall of the conveying space element, which wall at least partly delimits at least the conveying space, is at least largely equivalent to an at least two-dimensional geometry of at least one entire conveying surface of the spring-elastic conveying element in a state when the spring-elastic conveying element is deflected towards the rigid wall, and is in particular pre-determined by said latter two-dimensional geometry. It is preferably the case that, in a state when the spring-elastic conveying element is deflected entirely towards the rigid wall, the spring-elastic conveying element bears at least partly, in particular at least linearly, against the conveying contour of the rigid wall, which at least partly delimits at least the conveying space, of the conveying space element, in particular as viewed in a plane which runs at least substantially transversely with respect to the conveying direction. The spring-elastic conveying element preferably has a concave curvature in a state in which the spring-elastic conveying element is deflected entirely towards the rigid wall. By means of the embodiment according to the invention, it is advantageously possible to realize a high level of conveying performance of the conveying device. It is advantageously possible to achieve a low load on the conveying element during a conveyance of a fluid.

It is preferably provided that a maximum extent of the conveying space along the conveying direction is several times greater than a maximum extent of the conveying space along a direction running at least substantially transversely, in particular at least substantially perpendicularly, with respect to the conveying direction. It is preferably the case that a maximum extent of the conveying space along the conveying direction amounts to at least 1.5 times, preferably at least two times and particularly preferably at least four times a maximum extent of the conveying space along a direction running at least substantially transversely, in particular at least substantially perpendicularly, with respect to the conveying direction. It is preferable for the conveying space to run in particular in a manner that differs from a spiral shape. By means of the embodiment according to the invention, it is advantageously possible to realize a particularly compact conveying device.

It is furthermore proposed that, viewed in at least one plane, in particular viewed in at least one plane running at least substantially parallel to the conveying direction, the conveying space extends along an angle range of more than 180°, in particular of more than 220° and particularly preferably of more than 270°. By means of the embodiment according to the invention, it is advantageously possible for a large volume of a fluid to be conveyed in a small installation space of the conveying device.

The drive unit is preferably provided for acting on the conveying element such that, by means of the conveying element, a conveyance of a fluid in accordance with a traveling-wave principle can be made possible. The drive unit may be in the form of a mechanical drive unit, a magnetic drive unit, a piezoelectric drive unit, a hydraulic drive unit, a pneumatic drive unit, an electric drive unit, a magnetorheological drive unit, a carbon tubes drive unit, a combination of said types of drive units, or some other drive unit that appears expedient to a person skilled in the art. It is alternatively also conceivable for the pump device to be operable manually, in particular by hand. In an embodiment of the pump device as a manually operable pump device, a fluid can be at least transported into the conveying space as a result of an action of a force exerted on the conveying element by a hand, in particular by at least one finger, of an operator, and/or can be at least transported out of the conveying space as a result of an action of a force exerted on the conveying element by a hand, in particular by at least one finger, of an operator. The manually operable pump device preferably comprises at least one valve unit, which has for example at least one valve, in particular a one-way valve (for example check valve or the like) at a conveying space inlet and at least one valve, in particular a one-way valve (for example check valve or the like) at a conveying space outlet. The drive unit preferably comprises at least one force action element which is provided so as to act on the conveying element, in particular is provided so as to effect an elastic deformation, in particular a repeatable spring-elastic deformation, of the conveying element as a result of an action of a drive force on the conveying element. The force action element may be designed in any form that appears expedient to a person skilled in the art, and may for example be designed as a plunger, as a projection, as a helix, as a cam, as an eccentric, as a rolling element or the like. The force action element is preferably provided for acting directly on the conveying element. It is however also conceivable for at least one further element or further elements to be arranged between the force action element and the conveying element, such as for example a friction-reducing element, a support element, a damping element or the like. The pump device preferably comprises at least one housing unit, on or in which the exchangeable unit can be detachably arranged.

The drive unit is preferably in the form of a rotary drive unit. Here, a "rotary drive unit" is to be understood in particular to mean a drive unit which has at least one force action element which, for an action of a drive force, in particular a direct action of a drive force, on the conveying element, can be driven in rotation, wherein it is provided in particular that the force action element, for an action of a drive force on the conveying element, extends at least substantially parallel to a plane of rotation, in particular in the plane of rotation, in which the force action element can be driven in rotation.

It is particularly preferable for at least one drive axis of the drive unit to extend at least substantially transversely with respect to the conveying direction of the conveying device. The drive axis of the drive unit preferably runs at least substantially perpendicularly with respect to the conveying direction in the conveying space or through the conveying space of the conveying device. It is preferable for at least one axis of rotation, which forms the drive axis, of a rotor element of an electric motor unit of the drive unit to run at least substantially perpendicular to the conveying direction in the conveying space. It is however also conceivable for at least one drive axis of the drive unit to extend at least substantially parallel to the conveying direction of the conveying device, in particular with respect to a conveying direction in the conveying space. Here, the expression "at least substantially perpendicular" is to be understood in particular to mean an orientation of a direction relative to a reference direction, in particular in one plane, wherein the direction has a deviation relative to the reference direction of in particular less than 8°, advantageously less than 5° and particularly advantageously less than 2°. By means of the embodiment according to the invention, it is advantageously possible to realize a pump device which permits convenient exchangeability of individual components and/or units in order, in particular, to permit a demand for at least substantially sterile use or in order to permit fast replacement of defective components and/or units.

Here, the expression "movably supported" is intended in particular to define support of a unit and/or of an element in the case of which the unit and/or the element, in particular in a manner decoupled from an elastic deformation of the unit and/or the element, is capable of moving over at least a distance of greater than 2 mm, preferably greater than 5 mm and particularly preferably greater than 10 mm and/or is capable of moving about at least one axis through an angle of greater than 5°, preferably greater than 10° and particularly preferably greater than 15°. The drive element preferably encompasses the conveying space, in particular the conveying device, in particular at least over more than 60%, preferably over more than 80% and particularly preferably over more than 90% of an entire circumferential extent of the conveying space, in particular of the conveying device. The entire circumferential extent of the conveying space, in particular of the conveying device, runs in a plane which runs at least substantially parallel to the conveying direction and/or at least substantially perpendicular to the drive axis of the drive unit. The drive element preferably completely encompasses the conveying space, in particular the conveying device. The drive element is preferably designed such that the conveying device can be inserted or placed into the drive element. By means of the embodiment according to the invention, it is advantageously possible to realize convenient exchangeability of the conveying device. It is furthermore advantageously possible to realize a compact pump device.

The force action element can preferably be driven by means of the drive element of the drive unit. For a conveyance of a fluid through the conveying space, the force action element preferably circulates entirely around the conveying space, in particular through an angle range of 360°. It is preferably the case that, during a circulation about the conveying space, the force action element bears against the conveying element at at least one side of the conveying element. In particular, during a circulation, the force action element slides on a surface, which is averted from the conveying space, of the conveying element or rolls on the surface, which is averted from the conveying space, of the conveying element. The force action element may be provided for subjecting the conveying element to a force which acts along an axis running in a central plane of the conveying space and/or of the conveying device, or for subjecting the conveying element to a force which acts along an axis which is angled relative to the central plane of the conveying space and/or of the conveying device. The central plane and/or the axis along which a force can be exerted on the conveying element by the force action element preferably run(s) at least substantially transversely, in particular at least substantially perpendicularly, with respect to the drive axis of the drive unit. Furthermore, it is conceivable for the drive unit to have at least one spring element which is provided for subjecting the force action element to a spring force in the direction of the conveying element. By means of the embodiment according to the invention, it is advantageously possible to realize an easy removal of the conveying device. It is furthermore advantageously possible to realize a flat construction of the pump device.

It is furthermore proposed that the at least one force action element is embodied as a roller element, in particular as a sphere. It is however also conceivable for the force action element in the form of a roller element to have a design which differs from a sphere, and to be designed for example as a needle-type rolling element, as a roller-type rolling element, as a barrel-type rolling element or the like. By means of the design according to the invention, it is advantageously possible to realize low friction between the force action element and the conveying element for a conveyance of a fluid. It is advantageously possible to permit a long service life of the pump device.

It is furthermore proposed that the at least one force action element is supported in a receiving element of the drive unit in a freely rotatable fashion. Here, the expression "supported in a freely rotatable fashion" is to be understood in particular to mean rotatable support which has no fixedly predefined axis of rotation, or which has a multiplicity of axes of rotation. By means of the embodiment according to the invention, it is advantageously possible to achieve reliable removal of the conveying device without a force action element of the drive unit being undesirably lost or being removed with the conveying device.

It is furthermore proposed that the drive unit comprises a plurality of force action elements which are arranged equally distributed around the conveying space. The force action elements are preferably arranged in equally distributed fashion around the conveying space, in particular around the conveying device, on a circular path. The force action elements may be arranged in equally distributed fashion around the conveying space, in particular around the conveying device, in such a way that forces acting along an axis running in the central plane of the conveying space and/or of the conveying device can be exerted on the conveying element or in such a way that forces acting along at least one axis which is angled with respect to the central plane of the conveying space and/or of the conveying device can be exerted on the conveying element. It is furthermore conceivable for at least two force action elements, viewed along the drive axis of the drive unit, to be arranged one above the other, wherein each of the force action elements arranged one above the other can subject the conveying element in each case to a force acting along at least one axis which is angled with respect to the central plane of the conveying space and/or of the conveying device, wherein the axes are furthermore angled with respect to one another. The conveying device may comprise a plurality of conveying spaces which are formed in an annulus-shaped fashion and/or which, viewed in at least one plane, extend along an angle range of more than 180°. In an embodiment of the conveying device with more than one conveying space, it is conceivable for the conveying spaces to be arranged one behind the other as viewed along a circumferential direction, or for the conveying spaces to be arranged one above the other, in particular arranged offset with respect to one another in parallel, as viewed along the drive axis of the drive unit. In an embodiment of the drive unit with a plurality of force action elements which are provided for subjecting the conveying element in each case to a force acting along at least the axis which is angled with respect to the central plane of the conveying space and/or of the conveying device, the conveying device preferably comprises a plurality of conveying spaces which are arranged offset with respect to one another in parallel relative to the central plane of the conveying device. Further arrangements of the force action elements that appear expedient to a person skilled in the art are likewise conceivable. By means of the embodiment according to the invention, it is advantageously possible to achieve a high level of conveying performance.

It is furthermore proposed that the drive unit comprises a plurality of force action elements, which are supported in a receiving element of the drive unit in a freely rotatable fashion. The receiving element is preferably in the form of a cage, in particular a roller bearing-like cage. By means of the embodiment according to the invention, it is advantageously possible to achieve reliable removal of the conveying device without the force action elements of the drive unit being undesirably lost or being removed with the conveying device. It is furthermore advantageously possible to ensure mobility of the force action elements for the purposes of achieving low friction between the conveying element and the drive element.

It is furthermore proposed that at least the drive unit, together with the conveying device, has a roller bearing-like, in particular ball bearing-like structure. In particular, the drive unit comprises at least one drive element which is formed as an outer ring and which may be formed as one component or in multiple parts. The drive unit preferably comprises at least one force action element which is arranged in a receiving element formed as a cage and which is in the form of a roller element. The conveying device, in particular the conveying element, at least partly forms an inner ring. By means of the embodiment according to the invention, it is particularly advantageously possible to realize a flat construction of the pump device.

Here, it is not the intention for the conveying device according to the invention and/or the pump device according to the invention to be restricted to the usage and embodiment described above. In particular, in order to perform a function described herein, the conveying device according to the invention and/or the pump device according to the invention may have a number of individual elements, components and units and method steps which differs from a number mentioned herein. Furthermore, with regard to the value ranges specified in this disclosure, it is also intended that values lying within the stated limits are considered as disclosed and usable as desired.

DRAWINGS

Further advantages emerge from the following description of the drawings. The drawings illustrate an exemplary embodiment of the invention. The drawings, the description and the claims contain numerous features in combination. A person skilled in the art will expediently also consider the features individually and combine these to form further meaningful combinations.

Figure 2:
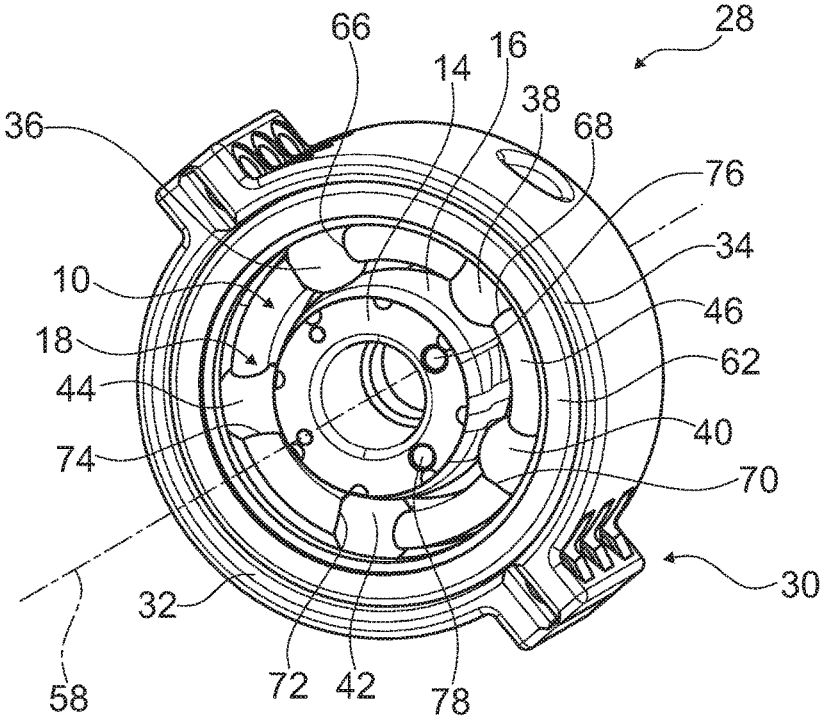
Figure 3:
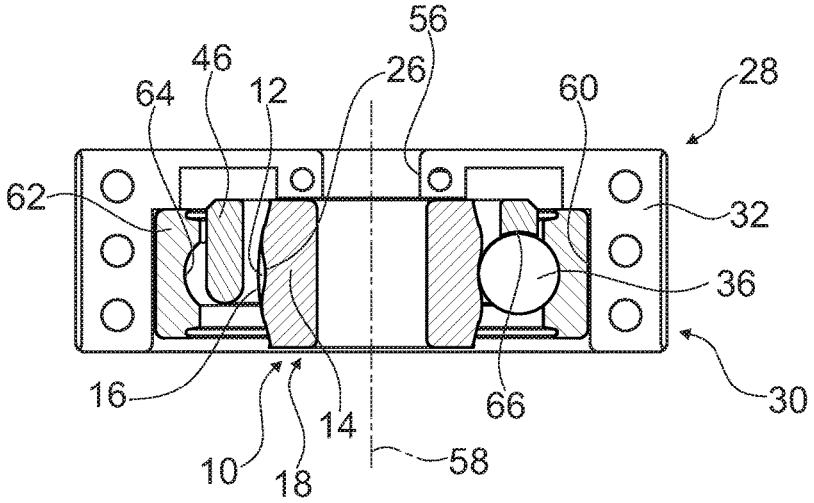
Figure 4:
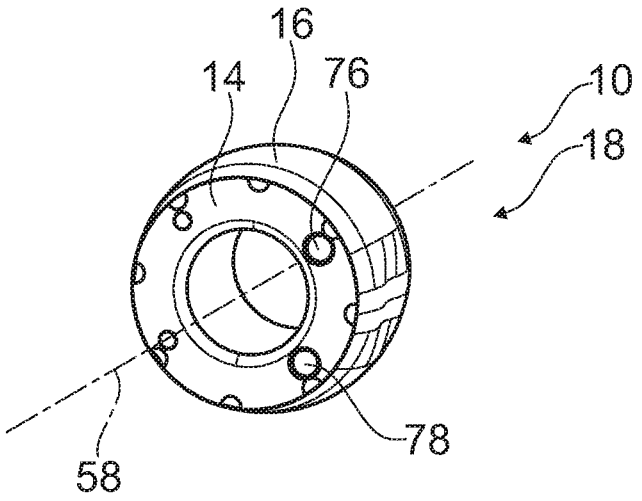
Figure 5:
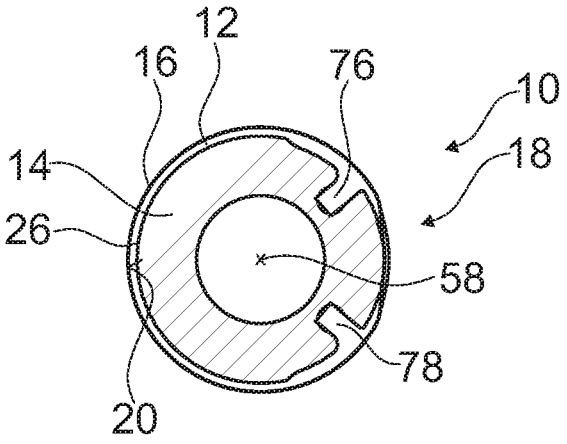
Figure 6:
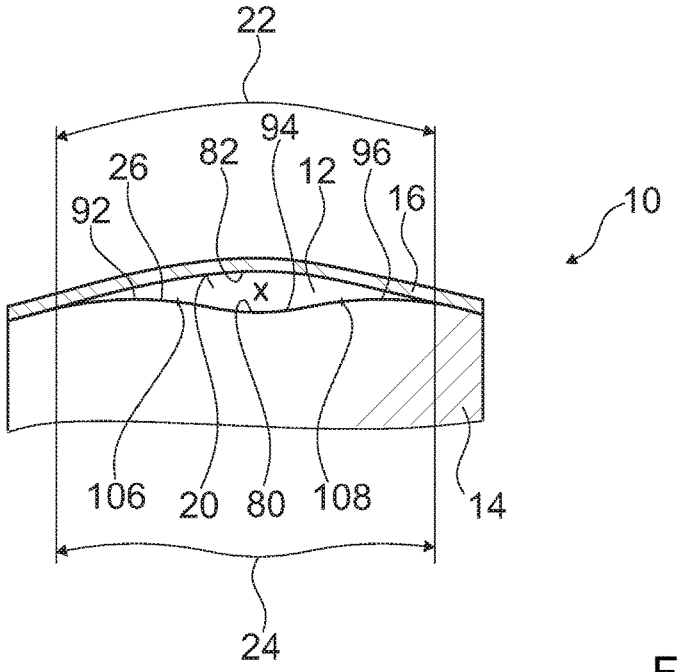
Figure 7:
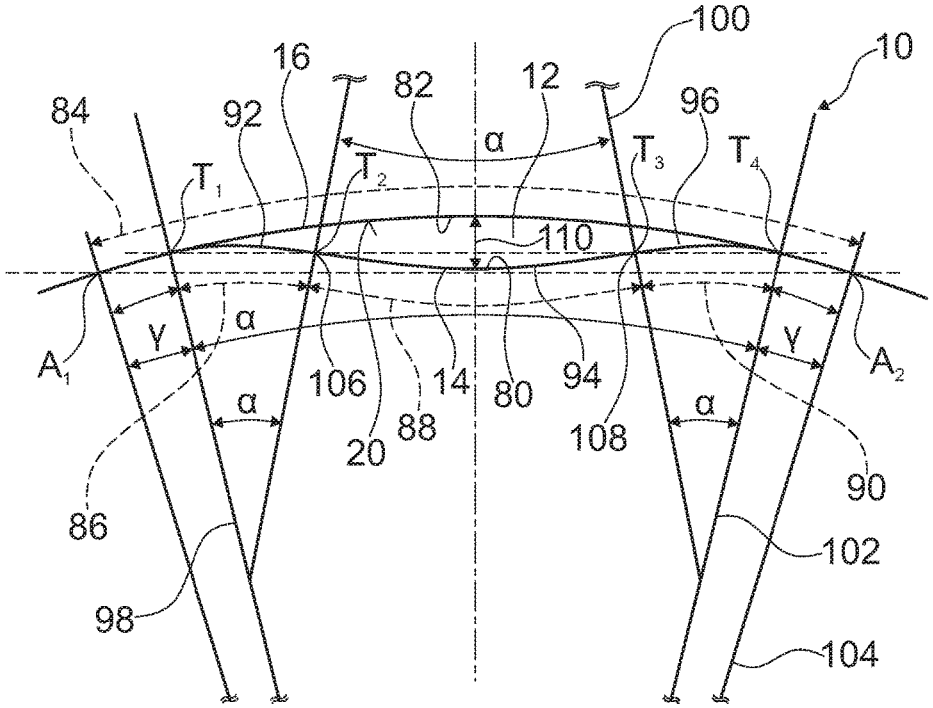

In the drawings:

FIG. 1 shows a pump device according to the invention with at least one conveying device according to the invention in a schematic illustration, FIG. 2 shows a detail view of a part of a drive unit of the pump device according to the invention and of the conveying device according to the invention in a schematic illustration, FIG. 3 shows a sectional view of the part of the drive unit of the pump device according to the invention and of the conveying device according to the invention in a schematic illustration, FIG. 4 shows a detail view of the conveying device according to the invention in a schematic illustration, FIG. 5 shows a sectional view of the conveying device according to the invention from FIG. 4 in a schematic illustration, FIG. 6 shows a cross-section through a conveying space of the conveying device according to the invention in an unloaded state of a conveying element of the conveying device according to the invention in a schematic illustration, and FIG. 7 shows a detail view of a geometrical design of the conveying element of the conveying device according to the invention and of a conveying space element of the conveying device according to the invention in a schematic illustration.

DESCRIPTION OF THE EXEMPLARY EMBODIMENT

FIG. 1 shows a pump device 28 with at least one conveying device 10 and with at least one drive unit 30 for acting on the conveying device 10. The pump device 28 comprises at least one housing 48, on and/or in which the conveying device 10 and/or the drive unit 30 can be arranged. The housing 48 at least partly encompasses the conveying device 10 and/or the drive unit 30. In particular, at least the drive unit 30 is fixable to the housing 48 by means of at least one fastening element (not illustrated in any more detail here) that appears expedient to a person skilled in the art. It is however also conceivable for the drive unit 30 to be fixable to the housing 48 merely by means of a form fit and/or a force fit. To generate a drive force, the drive unit 30 comprises at least one motor unit 52. The motor unit 52 is in the form of an electric motor unit, such as for example an electronically commutated electric motor unit (EC motor) or the like. The motor unit 52 is preferably in the form of a disk-rotor motor unit. It is advantageously possible to realize a pump device 28 of flat construction. It is however also conceivable for the motor unit 52 to be of some other design that appears expedient to a person skilled in the art, for example to be designed as a combustion engine unit, as a hybrid motor unit or the like. For control and/or regulation of the motor unit 52, the drive unit 30 comprises at least one control and/or regulation unit 50, which is of a design already known to a person skilled in the art.

The drive unit 30 has at least one movably supported drive element 32, 34 which encompasses at least a conveying space 12 of the conveying device 10, in particular the entire conveying device 10, at least to a large extent, in particular along at least a circumferential direction. The motor unit 52 is provided at least for a movement, in particular a rotation, of the at least one drive element 32, 34 of the drive unit 30. The drive unit 30 preferably comprises a drive shaft 54 which is provided for driving at least one drive element 32, 34. The drive shaft 54 is in particular connected to the at least one drive element 32, 34 by means of a force-fitting and/or form-fitting connection. In particular, the at least one drive element 32, 34 comprises at least one connection recess 56 (FIG. 3) which is provided for a connection to the drive shaft 54. It is however also conceivable for the pump device 28 to have, in addition to the drive unit 30, at least one gearing unit which is arranged between the drive shaft 54 and the at least one drive element 32, 34 and which is in particular connected in terms of drive to the drive shaft 54 and to the at least one drive element 32, 34. The at least one drive element 32, 34 has an annulus-shaped and/or disk-shaped design. The at least one drive element 32, 34 has, in particular, a receiving recess 60 in which at least the conveying device 10 can be arranged. The conveying device 10 can preferably be at least partly, in particular entirely, placed into the at least one drive element 32, 34 or arranged in the at least one drive element 32, 34, in particular in the receiving recess 60. The at least one drive element 32, 34 encompasses the conveying device 10 along a circumferential direction at least to a large extent, in particular entirely, in particular in a state in which the conveying device 10 and the drive unit 30 are arranged on the housing 48. The circumferential direction runs preferably in a plane extending at least substantially perpendicular to a drive axis 58 of the drive unit 30. The drive axis 58 of the drive unit 30 is preferably configured as an axis of rotation of the drive shaft 54. The drive unit 30 may have two drive elements 32, 34 which together form an annulus-shaped or disk-shaped drive element which is connected to the drive shaft 54 and which encompasses the conveying device 10 along the circumferential direction at least to a large extent. Further embodiments that appear expedient to a person skilled in the art are likewise conceivable.

The drive unit 30 has at least one force action element 36, 38, 40, 42, 44 which is configured so as to circulate at least partly around the conveying space 12 for the purpose of conveying a fluid through the conveying space 12 (FIGS. 2 and 3). The at least one force action element 36, 38, 40, 42, 44 can preferably be driven by means of the at least one drive element 32, 34 of the drive unit 30. For a conveyance of a fluid through the conveying space 12, the at least one force action element 36, 38, 40, 42, 44 preferably circulates entirely around the conveying space 12, in particular through an angle range of 360°. It is preferably the case that, during a circulation about the conveying space 12, the at least one force action element 36, 38, 40, 42, 44 bears against a conveying element 16 at at least one side of the conveying element 16. In particular, during a circulation, the at least one force action element 36, 38, 40, 42, 44 slides on a surface, which is averted from the conveying space 12, of the conveying element 16 or rolls on the surface, which is averted from the conveying space 12, of the conveying element 16. The at least one force action element 36, 38, 40, 42, 44 may be provided for subjecting the conveying element 16 to a force which acts along an axis running in a central plane of the conveying space 12 and/or of the conveying device 10, or for subjecting the conveying element 16 to a force which acts along an axis which is angled relative to the central plane of the conveying space 12 and/or of the conveying device 10. The central plane and/or the axis along which a force can be exerted on the conveying element 16 by the at least one force action element 36, 38, 40, 42, 44 preferably run(s) at least substantially transversely, in particular at least substantially perpendicularly, with respect to the drive axis 58 of the drive unit 30. Furthermore, it is conceivable for the drive unit 30 to have at least one spring element (not illustrated in any more detail here) which is provided for subjecting the at least one force action element 36, 38, 40, 42, 44 to a spring force in the direction of the conveying element 16. The at least one force action element 36, 38, 40, 42, 44 is preferably embodied as a roller element, in particular as a sphere. It is however also conceivable for the at least one force action element 36, 38, 40, 42, 44 in the form of a roller element to have a design which differs from a sphere, and to be designed for example as a needle-type rolling element, as a roller-type rolling element, as a barrel-type rolling element or the like. The at least one force action element 36, 38, 40, 42, 44 is provided for generating a traveling-wave movement of the conveying element 16 along the circumferential direction. It is conceivable for the at least one force action element 36, 38, 40, 42, 44 to act directly on the conveying element 16 or for an exciter element (not illustrated in any more detail here) to be arranged between the at least one force action element 36, 38, 40, 42, 44 and the conveying element 16, which exciter element is acted on directly by the at least one force action element 36, 38, 40, 42, 44, wherein the exciter element bears against the conveying element 16 and transmits an action of drive forces to the conveying element 16.

The at least one force action element 36, 38, 40, 42, 44 is mounted in freely rotatable fashion in a receiving element 46 of the drive unit 30. The receiving element 46 has an annulus-shaped form. The receiving element 46 comprises at least one support recess 66, 68, 70, 72, 74 in which the at least one force action element 36, 38, 40, 42, 44 is arranged in a freely rotatable fashion. The receiving element 46 preferably comprises a plurality of support recesses 66, 68, 70, 72, 74 in which the force action elements 36, 38, 40, 42, 44 are arranged in freely rotatable fashion. In particular, a single force action element of the force action elements 36, 38, 40, 42, 44 is arranged in each of the support recesses 66, 68, 70, 72, 74 of the receiving element 46. The receiving element 46 is preferably in the form of a cage, in particular a roller bearing-like cage. The receiving element 46 encompasses the conveying space 12, in particular the conveying device 10, at least to a large extent, in particular entirely. The receiving element 46 is preferably arranged in the receiving recess 60 of the at least one drive element 32, 34 (FIG. 3). The drive unit 30 preferably comprises a plurality of force action elements 36, 38, 40, 42, 44 which are arranged equally distributed around the conveying space 12. In particular, the drive unit 30 has a plurality of force action elements 36, 38, 40, 42, 44 which are supported in the receiving element 46 of the drive unit 30 in freely rotatable fashion. The force action elements 36, 38, 40, 42, 44 are of at least substantially analogous design. In particular, the force action elements 36, 38, 40, 42, 44 are embodied as roller elements, in particular as spheres.

The drive unit 30 furthermore comprises at least one guiding element 62 which is provided at least for guiding the at least one force action element 36, 38, 40, 42, 44, in particular the force action elements 36, 38, 40, 42, 44. The guiding element 62 is arranged on the at least one drive element 32, 34 (FIG. 3). The guiding element 62 is in particular of annulus-shaped form. The guiding element 62 encompasses the conveying device 10 along the circumferential direction at least to a large extent, in particular entirely, in particular in a state in which the conveying device 10 is arranged on the at least one drive element 32, 34. The guiding element 62 is preferably arranged in the receiving recess 60 of the at least one drive element 32, 34 (FIG. 3). The guiding element 62 is fixed to the at least one drive element 32, 34 by means of a force-fitting and/or form-fitting connection, in particular by means of an interference fit. It is however also conceivable for the guiding element 62 to be formed in one piece with the at least one drive element 32, 34. The guiding element 62 comprises at least one guiding track 64 on which the at least one force action element 36, 38, 40, 42, 44, in particular the force action elements 36, 38, 40, 42, 44, slide(s) or on which the at least one force action element 36, 38, 40, 42, 44, in particular the force action elements 36, 38, 40, 42, 44, roll(s). The at least one guiding track 64 is preferably arranged on a side, facing toward the conveying device 10, of the guiding element 62. The at least one guiding track 64 encompasses the conveying device 10 preferably in an annulus-shaped fashion. It is however also conceivable for the guiding element 62 to have a number of guiding tracks 64 which differs from one, in particular a number of guiding tracks 64 which is dependent on an arrangement of the force action elements 36, 38, 40, 42, 44.

In a state in which the conveying device 10 is arranged on the drive unit 30, individual elements of the drive unit 30 and/or of the conveying device 10 are preferably arranged as follows, in particular proceeding from the drive axis 58 as viewed along a direction running at least substantially perpendicular to the drive axis 58: the conveying device 10, the force action elements 36, 38, 40, 42, 44, which are arranged in particular in the receiving element 46, the guide element 62 and the at least one drive element 32, 34. It is however also conceivable for the individual elements of the drive unit 30 and/or of the conveying device 10 to have some other arrangement that appears expedient to a person skilled in the art. It is particularly preferable for the conveying device 10, the force action elements 36, 38, 40, 42, 44, the receiving element 46 and the guiding element 62 to be arranged at least to a large extent in the at least one drive element 32, 34, in particular in the receiving recess 60 of the at least one drive element 32, 34. At least the drive unit 30, together with the conveying device 10, has a roller bearing-like, in particular ball bearing-like structure (FIGS. 2 and 3). The entire conveying device 10 is preferably implemented in an annulus-shaped fashion.

The at least one drive element 32, 34 can be driven in rotation by means of the motor unit 52, in particular by means of the drive shaft 54. As a result of a rotation of the at least one drive element 32, 34 and a fixed connection between the at least one drive element 32, 34 and the guiding element 62, the at least one drive element 32, 34 and the guiding element 62 can be jointly driven in rotation about the drive axis 58. The at least one force action element 36, 38, 40, 42, 44, in particular the force action elements 36, 38, 40, 42, 44, is/are driven in rotation about the drive axis 58, in particular during a rotation of the at least one drive element 32, 34 and of the guiding element 62 about the drive axis 58, owing to friction between the guiding element 62 and the at least one force action element 36, 38, 40, 42, 44, in particular the force action elements 36, 38, 40, 42, 44. The at least one force action element 36, 38, 40, 42, 44, in particular the force action elements 36, 38, 40, 42, 44, circulate about the conveying device 10, in particular the conveying space 12, such that, as a result of an exertion of force on the conveying element 16 by the force action element 36, 38, 40, 42, 44, in particular the force action elements 36, 38, 40, 42, 44, a fluid is conveyed through the conveying space 12, in particular by means of a spring-elastic deformation of the conveying element 16 (FIG. 3).

The conveying device 10 for conveying a fluid comprises at least the conveying space 12, at least one conveying space element 14, which at least partly delimits the conveying space 12 and is embodied in a rigid fashion, and at least the elastically deformable conveying element 16, which forms the conveying space 12 together with the conveying space element 14 (FIGS. 3 and 5 to 7). The conveying space 12 is preferably implemented in an annulus-shaped fashion. Viewed in at least one plane, the conveying space 12 extends along an angle range of more than 180° along the circumferential direction, in particular along an angle range of more than 270° along the circumferential direction. The conveying element 16 is embodied in a spring-elastic fashion, wherein at least the conveying space element 14 and the conveying element 16 together form an exchangeable unit 18. The spring-elastic conveying element 16 comprises at least one conveying surface 20 which, viewed in a cross-section of the conveying element 16, has a maximum transverse extent 22 which is at least substantially, in particular entirely, equivalent to a maximum transverse extent 24 of a rigid wall 26 of the conveying space element 14, which wall at least partly delimits at least the conveying space 12 (FIGS. 3, 6 and 7). It is preferable if at least one two-dimensional geometry of an entire conveying contour of the rigid wall 26 of the conveying space element 14, which wall at least partly delimits at least the conveying space 12, is at least largely, in particular entirely, equivalent to an at least two-dimensional geometry of the at least one entire conveying surface 20 of the spring-elastic conveying element 16 in a state when the spring-elastic conveying element 16 is deflected towards the rigid wall 26. In particular, the at least one two-dimensional geometry of the entire conveying contour of the rigid wall 26 of the conveying space element 14, which wall at least partly delimits at least the conveying space 12, is at least largely, in particular entirely, predetermined by the at least two-dimensional geometry of the at least one entire conveying surface 20 of the spring-elastic conveying element 16 in a state when the spring-elastic conveying element 16 is deflected towards the rigid wall 26.

The pump device 28 and/or the conveying device 10 preferably comprises at least one conveying medium store unit (not illustrated in any more detail here) for storing a fluid. It is conceivable for the conveying medium store unit to be formed separately from the conveying device 10 or for the conveying medium store unit to form the exchangeable unit 18 together with the conveying space element 14 and the conveying element 16. In the case of a conveying medium store unit formed separately from the conveying device 10, it is conceivable for the conveying medium store unit to be fluidically connectable, in particular detachably connectable, to the conveying space 12 by means of a conveying line, for example by means of a hose, of the pump device 28 and/or of the conveying device 10, and to be removable from the housing 48 separately from the exchangeable unit 18.

The conveying element 16 is provided for sealing off at least one edge region, which delimits the conveying space 12, of the conveying space element 14 (FIGS. 4 to 7). A fluid which can be conveyed in and/or through the conveying space 12 by means of an interaction of the conveying space element 14 and of the conveying element 16 can be introduced into the conveying space 12 via a conveying space inlet 76 of the conveying device 10 (FIGS. 2, 4 and 5). The conveying space inlet 76 is arranged on the conveying space element 14, and is in particular formed in one piece with the conveying space element 14. The conveying space inlet 76 is fluidically connectable to the conveying medium store unit, and in particular is fluidically connectable to a storage space outlet (not illustrated in any more detail here) of the conveying medium store unit. A fluid can be conveyed in and/or through the conveying space 12 by means of a reversible deformation of the conveying element 16. A fluid can be conveyed from the conveying space inlet 76 through the conveying space 12 to a conveying space outlet 78 of the conveying device 10 by means of a reversible deformation of the conveying element 16. The conveying space outlet 78 is arranged on the conveying space element 14, and is in particular formed in one piece with the conveying space element 14. The conveying space outlet 78 is fluidically connected to a further unit (not illustrated in any more detail here). The further unit may in this case be a part of the pump device 28, a part of an administration device on which the pump device 28 is arranged, a part of a household appliance on which the pump device 28 is arranged, a part of a motor vehicle injection device on which the pump device 28 is arranged, or the like. In an embodiment of the pump device 28 as part of an administration device, it is in particular conceivable for the further unit to be in the form of an injection unit, in particular in the form of a needle or syringe unit. The further unit may be directly connected to the conveying space outlet 78, or the further unit may be fluidically connected to the conveying space outlet 78 by means of a separate conveying line, for example a hose. Further fluidic connections of the further unit to the conveying space outlet 78 that appear expedient to a person skilled in the art are likewise conceivable.

FIG. 6 shows a cross-section through the conveying space 12, wherein the conveying element 16 is illustrated in an unloaded state. In particular, no conveyance of a fluid occurs in an unloaded state of the conveying element 16. The conveying element 16 can be arranged at least partly in convexly curved fashion on the conveying space element 14. The conveying element 16 is, at least in an unloaded state, in particular in a state in which it is not loaded by the action of a drive force that can be generated by means of the drive unit 30, arranged at least partly in convexly curved fashion on the conveying space element 14. The conveying space element 14 has at least one concave recess 80 for at least partly delimiting and/or for at least partly forming the conveying space 12. An inner surface, which delimits the recess 80, of the conveying space element 14 forms the rigid wall 26 of the conveying space element 14. The conveying element 16 is deformable such that, for a conveyance of a fluid, the conveying element 16 is movable in the direction of the recess 80 and is in particular movable at least partly into said recess (FIG. 3), in particular as a result of an exertion of force on the conveying element 16 by at least one of the force action elements 36, 38, 40, 42, 44. The conveying element 16 is of spring-elastic form. The conveying element 16 is connected at least substantially non-detachably to the conveying space element 14, in particular in an edge region, which delimits the recess 80, of the conveying space element 14. The at least substantially non-detachable connection of the conveying element 16 to the conveying space element 14 forms, in particular, a seal between the conveying element 16 and the conveying space element 14. It is however also conceivable for an additional seal element of the conveying device 10 to be arranged between the conveying element 16 and the conveying space element 14. The conveying space 12 can preferably be sealed off in fluid-tight fashion preferably as a result of a connection and/or arrangement of the conveying element 16 to and/or on the conveying space element 14, in particular when the conveying space inlet 76 and the conveying space outlet 78 are in a closed state.

The conveying element 16 comprises at least the conveying surface 20 which, viewed in a cross-section of the conveying element 16, in particular in a cross-section of the conveying space 12, has a maximum transverse extent 22 which is at least substantially, in particular entirely, equivalent to the maximum transverse extent 24 of the wall 26 of the conveying space element 14, which wall delimits the conveying space 12, in particular to the inner surface, which delimits the recess 80, of the conveying space element 14 (FIGS. 6 and 7). For a conveyance of a fluid in and/or through the conveying space 12, the conveying surface 20 can, as a result of an action of a drive force that can be generated by the drive unit 30, be caused to bear, in particular be caused to bear entirely, against the wall 26 of the conveying space element 14, which wall delimits the conveying space 12, in particular against the inner surface, which delimits the recess 80, of the conveying space element 14 (FIG. 3).

FIG. 7 shows a schematic illustration of a geometrical design of the conveying element 16 of the conveying device 10 and of the conveying space element 14 of the conveying device 10. The conveying element 16, in particular the conveying surface 20 of the conveying element 16, has, in an unloaded state, as viewed in a cross-section of the conveying element 16, at least one circular arc segment 82 which has a maximum length 84 which is made up of a sum of maximum lengths 86, 88, 90 of circular arc segments 92, 94, 96 of the rigid wall 26 of the conveying space element 14. Viewed in the cross-section of the conveying element 16, the conveying surface 20 of the conveying element 16 extends from a fastening region of the conveying element 16, which fastening region bears against the conveying space element 14 at all times when the conveying element 16 is in a state arranged on the conveying space element 14, to a further fastening region of the conveying element 16, which fastening region is arranged at an end of the conveying element 16 which is averted from the fastening region.

Viewed in a cross-section, the rigid wall 26 of the conveying space element 14 has the at least three successive circular arc segments 92, 94, 96. The circular arc segments 92, 94, 96 of the rigid wall 26 of the conveying space element 14 are part of the inner surface of the conveying space element 14. The inner surface of the conveying element 16 is arranged on a side, facing toward the conveying element 16, of the conveying space element 14. Viewed in a cross-section, the rigid wall 26 of the conveying space element 14 has at least the three circular arc segments 92, 94, 96, wherein at least two of the three circular arc segments 92, 94, 96 have different radii 98, 100, 102. Two of the three circular arc segments 92, 94, 96 of the rigid wall 26 of the conveying space element 14 have equal radii 98, 102. Said two of the three circular arc segments 92, 94, 96 of the rigid wall 26 of the conveying space element 14 are arranged at the outside. One of the three circular arc segments 92, 94, 96 of the rigid wall 26 of the conveying space element 14 has a radius 100 which differs from the radii 98, 102 of said two of the three circular arc segments 92, 94, 96 of the rigid wall 26 of the conveying space element 14 which are arranged at the outside. That one of the three circular arc segments 92, 94, 96 of the rigid wall 26 of the conveying space element 14 which has a different radius 100 in relation to said two of the three circular arc segments 92, 94, 96 of the rigid wall 26 of the conveying space element 14 is, as viewed along an at least substantially perpendicular to a conveying direction running through the conveying space 12, arranged between said two of the three circular arc segments 92, 94, 96 of the rigid wall 26 of the conveying space element 14 which have equal radii 98, 102. It is however also conceivable for all three circular arc segments 92, 94, 96 of the rigid wall 26 of the conveying space element 14 to have different or equal radii 98, 100, 102. Further embodiments of the radii 98, 100, 102 of the circular arc segments 92, 94, 96 of the rigid wall 26 of the conveying space element 14 that appear expedient to a person skilled in the art are likewise conceivable. The conveying element 16, in particular the conveying surface 20 of the conveying element 16, has, at least in an unloaded state of the conveying element 16, the at least one circular arc segment 82, which has a radius 104 which is greater than a radius 98, 100, 102 of at least one of the three circular arc segments 92, 94, 96 of the rigid wall 26 of the conveying space element 14.

It is preferable for at least the sum of the maximum lengths 86, 88, 90 of the three circular arc segments 92, 94, 96 of the rigid wall 26 of the conveying space element 14 to be equal to the maximum length 84 of the circular arc segment 82 of the conveying element 16, in particular of the conveying surface 20 of the conveying element 16. In the geometrical design of the conveying element 16 and of the conveying space element 14, the condition preferably applies that a distance between points $A_1$ and $A_2$ along the circular arc segment 82 of the conveying element 16 is, with regard to a length, equal to a distance between points $A_1$, $T_1$, $T_2$, $T_3$, $T_4$ and $A_2$ along the three circular arc segments 92, 94, 96 of the rigid wall 26 of the conveying space element 14. The maximum transverse extent 22 of the conveying surface 20 is particularly preferably equivalent to a length of the distance between the points $A_1$ and $A_2$. The maximum transverse extent 24 of the rigid wall 26 of the conveying space element 14, which wall at least partly delimits at least the conveying space 12, is preferably equivalent to a length of the distance between the points $A_1$, $T_1$, $T_2$, $T_3$, $T_4$ and $A_2$.

Viewed in the cross-section, the rigid wall 26 of the conveying space element 14 has at least the two directly successive circular arc segments 92, 94, 96, which are arranged so as to join one another at an inflection point 106, 108. Those two of the three circular arc segments 92, 94, 96 of the rigid wall 26 of the conveying space element 14 which are arranged at the outside are, in each case at an inflection point 106, 108, arranged so as to directly join that one of the three circular arc segments 92, 94, 96 of the rigid wall 26 of the conveying space element 14 which is arranged between said two of the three circular arc segments 92, 94, 96 of the rigid wall 26 of the conveying space element 14 which are arranged at the outside.

The conveying device 10 comprises a maximum conveying space height 110 between the conveying element 16 and the conveying space element 14, which conveying space height is smaller than a radius 98, 100, 102 of at least one of the three circular arc segments 92, 94, 96 of the rigid wall 26 of the conveying space element 14 and/or is smaller than the radius 104 of at least the circular arc segment 82 of the conveying element 16, in particular of the conveying surface 20 of the conveying element 16.

The invention claimed is:

1. A pump device with a conveying device, for a conveyance of a fluid, and a drive unit for acting on the conveying device, wherein the conveying device comprises a conveying space element, which at least partly delimits a conveying space and is rigid, and an elastically deformable conveying element, which forms the conveying space together with the conveying space element, the elastically deformable conveying element, following a deformation, seeks to re-assume an original, convexly curved shape of the elastically deformable conveying element, the elastically deformable conveying element is movable, starting from a convex curvature of the original convexly curved shape, which is oriented in a direction facing away from the conveying space element, towards the conveying space element, at least the conveying space element and the elastically deformable conveying element together form an exchangeable unit, the drive unit comprises a movably supported drive element, which encloses the conveying space at least over more than 60% of an entire circumferential extent of the conveying space, the drive unit comprises a force action element, which is configured to at least partly circulate around the conveying space, the conveying space is annular, the conveying space extends, viewed in a plane, about a center point that is arranged on an axis of rotation of the drive element, and the conveying space element comprises a concave recess for at least partly forming the conveying space.

2. The pump device according to claim 1, wherein the force action element is embodied as a roller element.

3. The pump device according to claim 1, wherein the force action element is supported in a receiving element of the drive unit, and the force action element is arranged to be freely rotatable in the receiving element.

4. The pump device according to claim 1, wherein the drive unit comprises a plurality of force action elements, which are arranged equally distributed around the conveying space.

5. The pump device according to claim 1, wherein the drive unit comprises a plurality of force action elements, which are supported in a receiving element of the drive unit, and each of the force action elements is arranged to be freely rotatable in the receiving element.

6. The pump device according to claim 1, wherein the drive unit, together with the conveying device, has a roller bearing-like structure.

7. A pump device that includes a conveying device, for conveying a fluid, and a drive unit, for acting on the conveying device, wherein the conveying device includes:

a conveying space element, which partly delimits a conveying space and is rigid; and an elastically deformable conveying element, which forms the conveying space together with the conveying space element, the elastically deformable conveying element, following a deformation, seeks to return to an original, convex shape of the elastically deformable conveying element, the elastically deformable conveying element is movable, starting from a convex curvature of the original, convex shape, which faces away from the conveying space element, towards the conveying space element, at least the conveying space element and the elastically deformable conveying element together form an exchangeable unit, the conveying space is annular, the conveying space extends, when viewed in a plane, about a center point that is arranged on an axis of rotation of a drive element of the drive unit, and the conveying space element includes a concave recess that partly forms the conveying space, the drive unit includes:

the drive element, which is movably supported and encloses the conveying space at least over more than 60% of an entire circumferential extent of the conveying space; and a force action element, which is configured to move about the conveying space.

8. The pump device according to claim 7, wherein the force action element is a roller element.

9. The pump device according to claim 7, wherein the force action element is supported in a receiving element of the drive unit, and the force action element is arranged to be freely rotatable in the receiving element.

10. The pump device according to claim 7, wherein the force action element is one of a plurality of force action elements, and wherein the force action elements are arranged to be equally distributed around the conveying space.

11. The pump device according to claim 7, wherein the force action element is one of a plurality of force action elements, the force action elements are supported in a receiving element of the drive unit, and each of the force action elements is arranged to be freely rotatable in the receiving element.

12. The pump device according to claim 7, wherein the drive unit, together with the conveying device, has a roller bearing-like structure.

* * * * *